United States Patent [19]

Powers

[11] Patent Number: 4,925,239

[45] Date of Patent: May 15, 1990

[54] FOLDING CHAIR AND METHOD OF CONSTRUCTION

[76] Inventor: Ronald H. Powers, 828 Production Pl., Newport Beach, Calif. 92663

[21] Appl. No.: 391,274

[22] Filed: Aug. 9, 1989

[51] Int. Cl.[5] ..... A47C 4/00

[52] U.S. Cl. ..... 297/29; 297/31; 297/17

[58] Field of Search ..... 297/29, 31, 17, 378, 297/188, 191; 248/188.9

[56] References Cited

U.S. PATENT DOCUMENTS

| | | | |
|---|---|---|---|
| 1,984,786 | 12/1934 | Dujardin . | |
| 2,803,291 | 8/1957 | Meyer . | |
| 2,815,799 | 12/1957 | Lo Vico . | |
| 2,943,672 | 7/1960 | Hook et al. | 297/31 |
| 3,092,224 | 6/1963 | O'Neil | 297/17 X |
| 3,151,909 | 10/1964 | Gerdetz . | |
| 3,292,830 | 12/1966 | Mack | 297/31 X |
| 3,695,685 | 10/1972 | Lamb | 297/29 |
| 4,014,591 | 3/1977 | Gittings . | |
| 4,273,380 | 6/1981 | Silvestri . | |
| 4,541,666 | 9/1985 | Vanderminden . | |
| 4,553,786 | 11/1985 | Lockett, III et al. . | |
| 4,577,901 | 3/1986 | Phillips | 297/17 |
| 4,676,548 | 6/1987 | Bradbury | 297/17 X |

FOREIGN PATENT DOCUMENTS

| | | |
|---|---|---|
| 11484/28 | 1/1928 | Australia . |
| 15253/33 | 11/1933 | Australia . |
| 17907 | 2/1938 | Australia . |
| 23264 | 3/1946 | Australia . |
| 132357 | 8/1946 | Australia . |
| 138851 | 10/1948 | Australia . |
| 35098 | 2/1956 | Australia . |
| 35662 | 8/1956 | Australia . |
| 261820 | 5/1960 | Australia . |
| 282570 | 9/1963 | Australia . |
| 45981 | 3/1964 | Australia . |
| 1398/66 | 2/1966 | Australia . |
| 14696/83 | 12/1966 | Australia . |
| 59454 | 10/1971 | Australia . |
| 60205 | 2/1972 | Australia . |
| 70871 | 12/1976 | Australia . |
| 85427 | 10/1981 | Australia . |
| 16906/83 | 10/1983 | Australia . |
| 96687 | 12/1985 | Australia . |
| 79833/87 | 10/1987 | Australia . |
| 99566 | 2/1988 | Australia . |

*Primary Examiner*—Peter A. Aschenbrenner
*Attorney, Agent, or Firm*—Lynn & Lynn

[57] ABSTRACT

A folding chair comprises lower and upper frame sections formed generally as U-shaped members, each having a pair of legs and a central portion between the pair of legs. The ends of the central section are connected to the legs by a pair of curved frame portions curved in planes such that the central frame portions have longitudinal axes displaced away from the legs. The frame sections are preferably formed to be generally identical except that the legs of one frame section may be longer than the legs of the other. The ends of the frame sections are connected together by hinges. A flexible material formed generally as a sling is mounted to the central portions of the upper and lower frame sections to support the weight of a person sitting in the chair. The frame and the hinges the legs cooperate to retain the angle between the upper and lower frame sections at an value determined by the position of the user in the chair. The pivotal connections between the legs includes means for preventing the ends of the legs from extending to the floor. The folding chair may include a pair of pouches behind the seat covering for storing small articles and for storing the covering when the chair is not in use.

14 Claims, 5 Drawing Sheets

FOLDING CHAIR AND METHOD OF CONSTRUCTION

BACKGROUND OF THE INVENTION

This invention relates generally to chairs or the like in which a person may sit. The invention relates particularly to folding chairs that have a frame and a flexible covering on the frame for supporting the weight of a person. This invention particularly relates to a folding chair in which a person sitting in the chair may adjust the angle between the seat and back by shifting his weight in the chair.

There are several known folding chair structures, most of which are designed for use on lawns, patios and beaches. The prior art is represented by the following listed U.S. patents: 1,584,786 to Dujardin; 2,803,29 to Meyer; 2,815,799 to Lo Vico; 2,943,672 to Hook et al.; 3,151,909 to Gerdetz; 4,014,591 to Gittings; 4,273,380 to Silvestri; 4,676,548 to Bradbury; 4,541,666 to Vanderminden; and 4,553,786 to Locket, III et al.

SUMMARY OF THE INVENTION

A folding chair according to the present invention comprises upper and lower frame sections preferably formed generally as U-shaped members. A pair of hinges connect the lower frame section and the upper frame section together. Each hinge preferably includes a bolt and a support ring mounted on the bolt. An end of each frame section is pivotally mounted on the bolt adjacent the support ring. The support ring is formed to have an outer surface that extends beyond the end edges of the frame sections such that when the chair rests upon a hard, flat surface such as a floor, the support ring contacts the floor while holding the ends of the frame sections above the floor. The hinge includes means mounted on the bolt between the ends of the frame sections for permitting the frame sections to rotate about the bolt relative to one another while preventing frictional contact between the frame ends. The chair also includes a covering mounted to the upper and lower frame sections such that a person occupying the chair may adjust the angle between the upper and lower frame sections by shifting his weight in the chair. A lower frame section formed generally as a U-shaped member having a first pair of legs and a first central portion between the first pair of legs.

The folding chair may include a pair of pouches connected to the covering behind the seatback. The seat and back section of the folding chair preferably includes a lower pocket formed to fit upon the lower frame section, and an upper pocket formed to fit upon the central portion of the upper frame section. Each of the lower and upper pockets may include a pair of cutout portions arranged so that the ends of the first and second central portions extend out of their respective pockets.

DESCRIPTION OF THE PREFERRED EMBODIMENT

Figure 1:
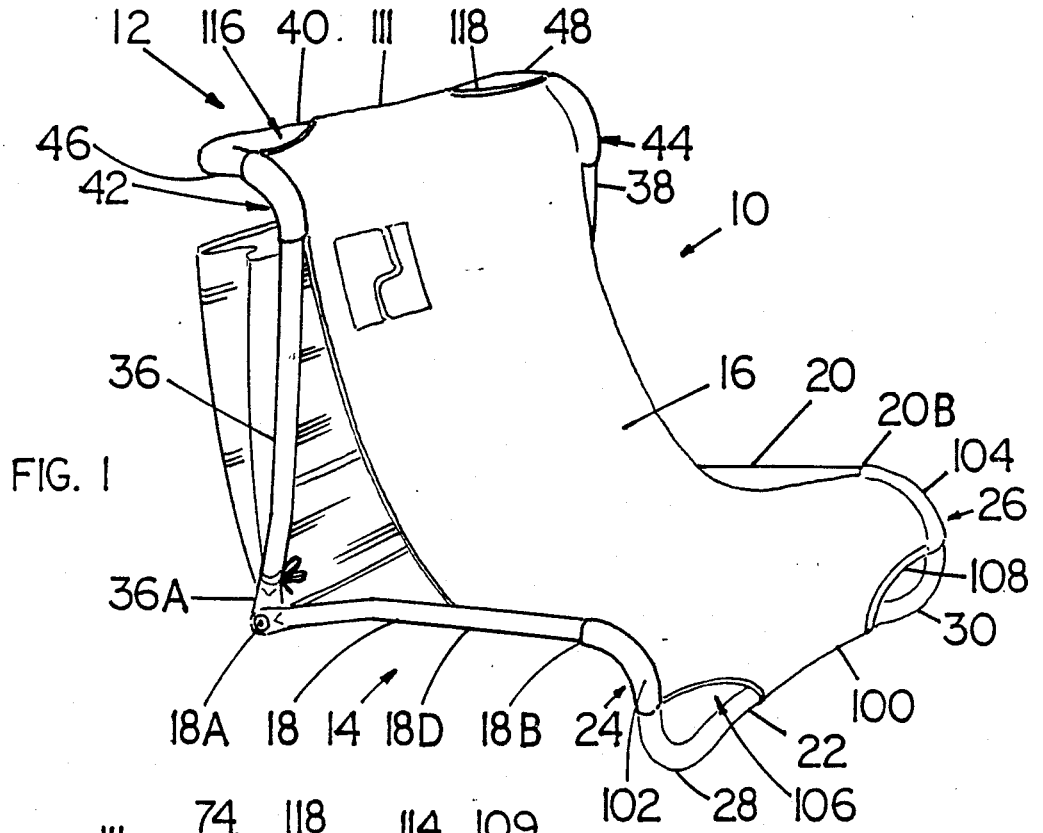
FIG. 1 is a perspective view of a folding chair according to the present invention showing a frame and a covering.

Referring to FIG. 1, a folding chair 10 includes an upper frame section 12, a lower frame section 14 and a covering 16. The frame sections 12 and 14 are preferably formed of a metal such as aluminum or steel or of a rigid non-metallic material. The frame sections 12 and 14 may be conveniently formed of metal tubing having an outside diameter in the range of 0.75 inch to 1.0 inch. Other tubing diameters may be used without departing from the scope of the present invention. The covering 16 is preferably formed of a fabric such as cotton, nylon or other similar textile material.

Figure 2:
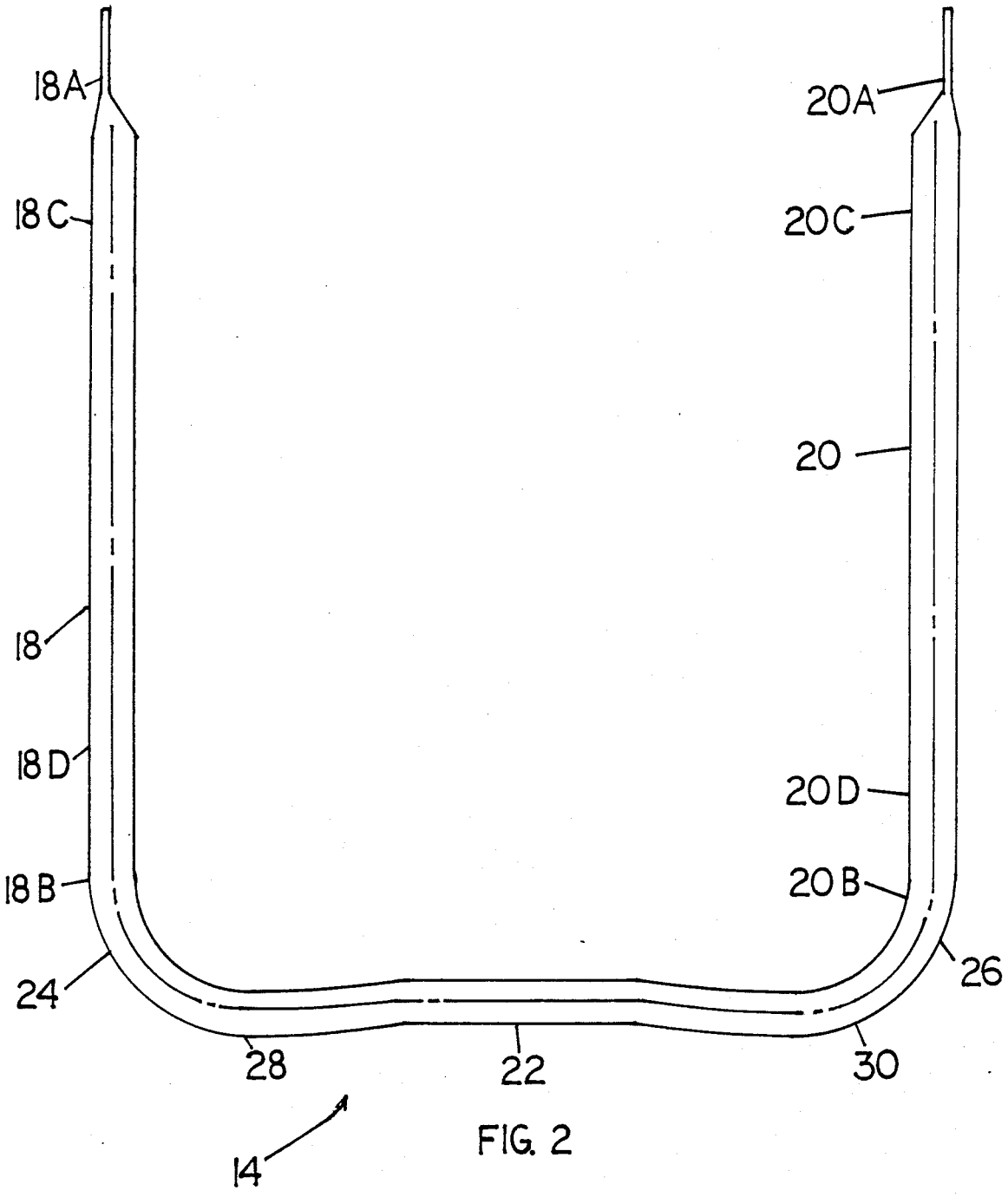
FIG. 2 is a top plan view of a portion of the frame that may be included in the folding chair of FIG. 1.

Referring to FIGS. 1 and 2, the lower frame section 14 is formed as a generally U-shaped member having legs 18 and 20 and a central portion 22. The leg 18 has ends 18A and 18B. The leg 20 has ends 20A and 20B as best shown in FIG. 2 and is formed to be substantially identical with the leg 18. The legs 18 and 20 are arranged to be generally parallel so that they define a plane.

The end 18B is connected to a curved section 24, and the end 20B is connected to a curved section 26. The curved sections 24 and 26 preferably make angles that with the legs 18 and 20, respectively of about 95°. The central portion 22 terminates in curved sections 28 and 30 that connect to the curved sections 24 and 26, respectively. The curved sections 28 and 30 preferably form angles of about 105° with the central portion 22. The numerical values of angles given herein are exemplary only and are not critical to practicing the invention.

Referring to FIG. 1, the central portion 22 is connected to the curved sections 28 and 30 so that when the chair 10 rests upon a horizontal surface such as a floor (not shown), the lower edges of the curved sections 28 and 30 extend below the central section 22. The therefore, the curved sections 28 and 30 provide the contact with the supporting surface to hold up the weight of the chair. Having the central section 22 above the floor prevents the covering 16 from contacting the floor and becoming damaged.

Therefore, the central portion 22 of the lower frame section 14 is displaced generally downward from the plane of the legs 18 and 20 as viewed in FIG. 1 such that the central portion 22 is not coplanar with the legs 18 and 20. The center of the section 22 preferably is displaced six to eight inches from the center line of leg 18. Having the section 22 displaced downward prevents it from pressing against the legs of a person sitting in the chair and holds the front edge of the seat of the chair above the surface upon which the chair rests. The actual downward displacement of the section 22 from the leg 18 depends upon how high the front of the seat is to be above the surface upon which the chair rests. In a particular preferred embodiment of the invention, the section 22 is displaced about 6.75 inches from the legs 18 and 20.

Figure 3:
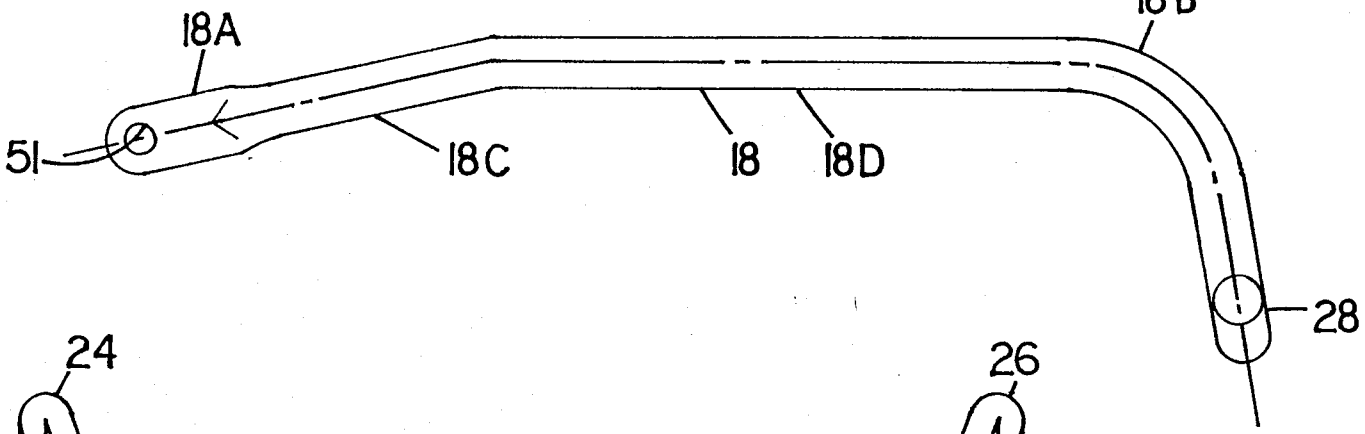
FIG. 3 is a side elevation view of the portion of the frame shown in FIG. 2.
Figure 4:
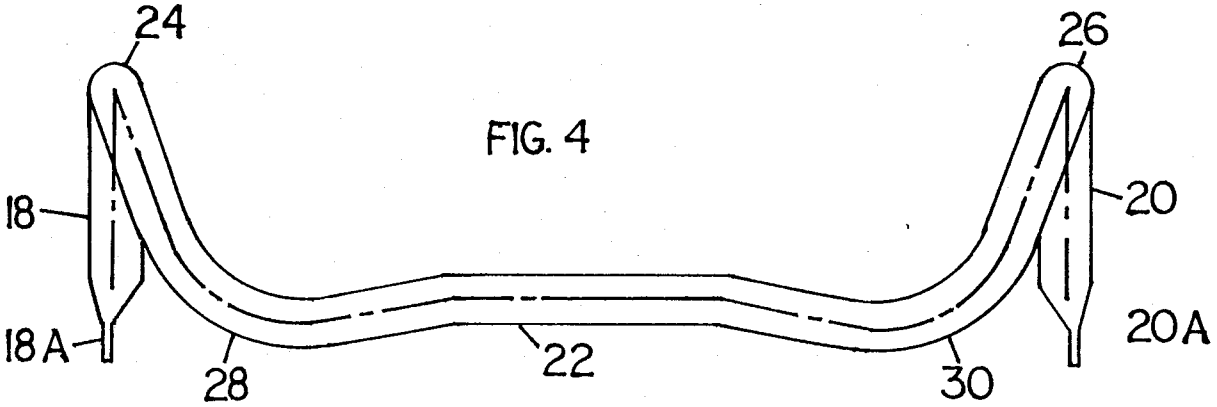
FIG. 4 is a front elevation view of the portion of the frame shown in FIG. 2.

Referring to FIGS. 1, 2 and 3, the leg 18 may comprise a first straight section 18C and a second straight section 18D at an angle to the section 18C. The sections 18C and 18D are preferably formed by bending a length of metal tubing or the like so that the sections 18C and 18D form an angle of about 10° with one another. The leg 20 preferably also has a pair of straight sections shown in FIG. 2. The sections 20C and 20D are also preferably at an angle of about 10° to one another.

The upper frame section 12 is formed generally similar to the lower frame section 14. The upper frame section 12 has legs 36 and 38 and a central section 40. The legs 18 and 36 are connected by a hinge assembly 49. The legs 20 and 38 are connected by a similar hinge (not shown).

Figure 7:
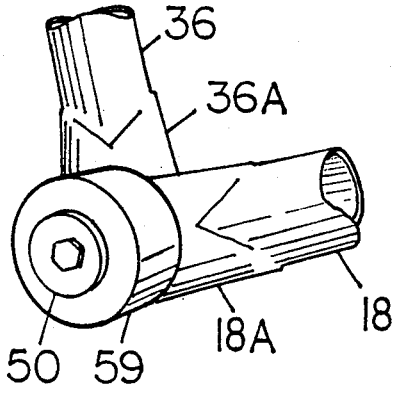
FIG. 7 is a perspective view showing a connection between a pair of frame members that may be included in the folding chair according to the present invention.
Figure 9:
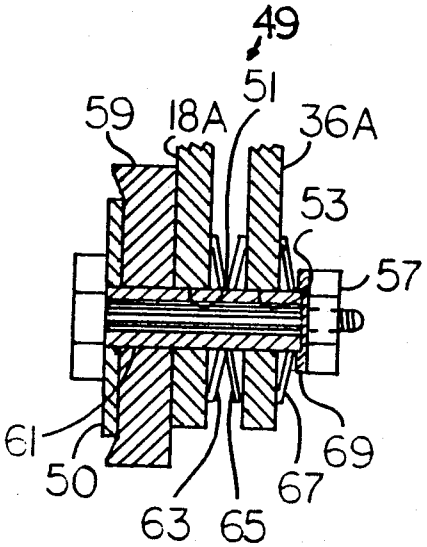
FIG. 9 is a cross sectional view of the hinged connection between the legs of the upper and lower frame sections of FIG. 1.

The connected ends of the frame sections are preferably flattened as shown in FIG. 1–4 to facilitate connecting them together to form a hinge as shown in FIGS. 7 and 9. The end 18A may formed integrally with the leg 18, or it may be separate piece of tubing that is telescopically connected with the leg 18. The end 18A may include a sleeve of tubing having an outside diameter that is slightly smaller than the inside diameter of the tubing that forms the section 18. The sleeve thus provides two additional layers of material to provide increased strength when the sleeve and tubing are flattened to complete formation of the end 18A. The ends of the frame sections 20, 36 and 38 may be formed to be substantially identical with the end 18A.

The upper frame section 12 has curved sections 42 and 44 connected to the legs 36 and 38, respectively. The curved sections 42 and 44 are similar to the curved sections 24 and 26, respectively. The only difference between the frame sections 12 and 14 is that the lower frame section preferably has slightly longer legs. This difference in length allows the ends of the frame to overlap when the frame is folded backward for carrying or for storage. The overlap between the frame sections provides better balance for carrying the chair and items carried in pouches, described subsequently, using the longer frame section as a handle.

A pair of curved sections 46 and 48 connect the curved sections 42 and 44 to the central section 40. The central section 40 is therefore displaced from the center lines of the legs 36 and 38. Since the upper and lower frame sections 12 and 14, respectively are preferably formed to be substantially identical, the rearward displacement of the central section 40 is generally equal to the displacement of the central section 22 from the centers of the portions 18D and 20D of the legs 18 and 20, respectively. Having the central section 40 displaced to the rear of the chair prevents the users head from contacting the upper frame section in normal usage. As seen in FIG. 1, the central sections 22 and 40 are substantially parallel to one another.

The ends 18A and 20A are preferably flattened as shown in FIG. 1–4 so that they can be easily joined together at a hinge assembly 49 so that they are rotatable with respect to one another as shown in FIGS. 1 and 7. Referring to FIG. 9, there is shown a preferred type of connection between the legs 18 and 36. Referring to FIGS. 3 and 9, the leg 18 has a passage 51 in the flattened portion of the end 18A. The leg 36 includes a similar passage 53, shown in FIG. 9, in its lower end 36A.

Referring to FIGS. 7 and 9, a bolt 55 passes through the passages 51 and 53 and is secured by a nut 57. The bolt 55 also preferably passes through a cylindrical support/protector ring 59 having an axial passage 61 therein. The support/protector ring 59 preferably has a recessed outer face as shown in FIG. 9. The outer face of the support/protector ring 59 may however by flat as shown in FIG. 7.

A washer 50 is preferably placed between the head of the bolt 55 and the support/protector ring 59. When the support/protector ring 59 has a recessed outer face, the washer 50 fits in the recess. The hinge assembly 49 preferably includes a pair of Belleville washers 63 and 65 between the ends 18A and 36A. The Belleville washers 63 and 65 are mounted so that their larger ends abut the ends 20A and 36A, respectively, while the smaller ends of the washers abut one another. The end 18A is therefore held between the support/protector 59 an the washer 63.

A third Belleville washer 67 has its larger end abutting the other side of the end 36A so that the end 36A is held between the washers 65 and 67. The three Belleville washers preferably are formed of hardened spring steel. The hinge assembly 49 may include a sleeve 68 that extends through the axial passages 51, 53, and 61 and the holes in the washers 50, 63, 56 and 67. The sleeve 68 provides a bearing surface upon which the legs 18 and 36 may rotate. A machined alignment collar 69 may be mounted on the sleeve 68 adjacent the washer 67. The alignment collar 69 assures proper alignment of the other parts of the hinge 49.

The nut 57 is sufficiently tight on the bolt 55 to compress the washers 63, 65 and 67 against the ends 18A and 36A. The edges of the Belleville washers engage the flat surfaces of the legs such that there is no movement of the washers relative to the legs when the upper and lower frame members rotate relative to one another. Instead, the movement is between the abutting edges of the washers 63 and 65 and between the washer 67 and the alignment collar 69. The orientation of the washers 63, 56 and 67, the ends 18A and 20A, the support/protector ring 59 and the alignment collar effectively prevent dirt from entering the hinge and interfering with its operation.

The support/protector ring 59 has a diameter sufficiently large that the outer curved surface of the support/protector ring 59 extends beyond the ends of the legs 18 and 36 for all possible angles of the seat and back portions of the folding chair 10. Therefore, the hinge 49 allows pivotal movement between the legs 18 and 20 without damaging the tubing that forms the frame.

Therefore, when the folding chair 10 rests upon a firm surface, such as floor (not shown) only the outer edge of the support/protector ring 59 contacts surface. The support/protector ring 59 thus permits adjustment of the angle of the seat and back without marring a floor that supports the folding chair 10 and without damaging the ends of legs 18, 20, 36 and 38.

Figure 6:
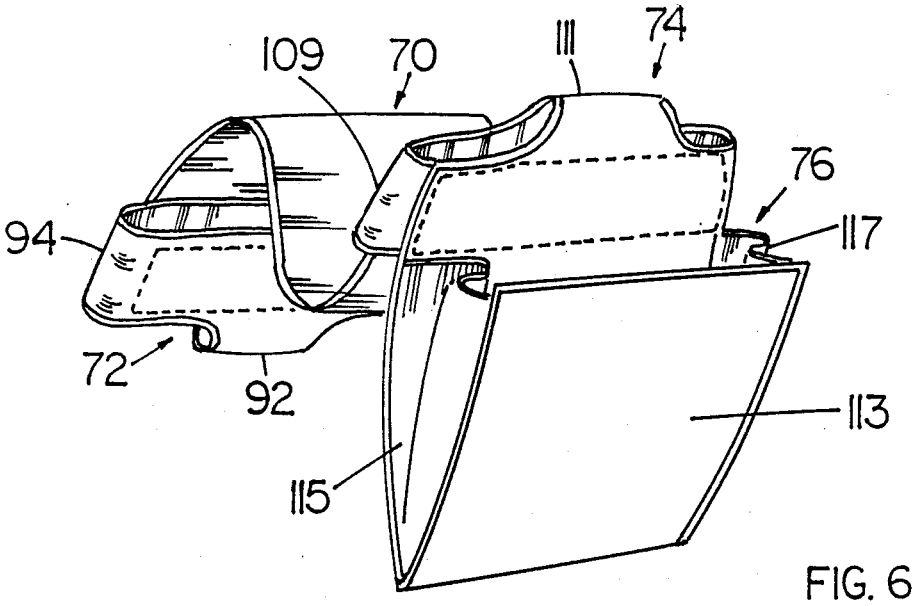
FIG. 6 is a perspective view of the covering of FIGS. 1 and 2 as seen from an angle reverse to that of FIG. 2.

Referring to FIGS. 1, 6 and 7, the covering 16 includes a seat and back support portion 70. The covering 16 may also include a lower pocket 72 and an upper pocket 74 that may be used to mount the covering 16 to the lower frame section 14 and the upper frame section 12.

The covering 16 may also include an first pouch 76 and a second pouch 78 that depend from the upper pocket 74. The first pouch 76 and the second pouch 78 provide convenient means for storing small articles, such as keys, reading material, suntan lotion and the like. When the lower pocket 72 is removed from the lower frame section 14, the covering 16 may be rolled up and stored in the pouch 78. The second pouch 78 is also particularly useful for storing articles away from public view if the user wants to leave his belongings with the chair for a short time.

Figure 5:
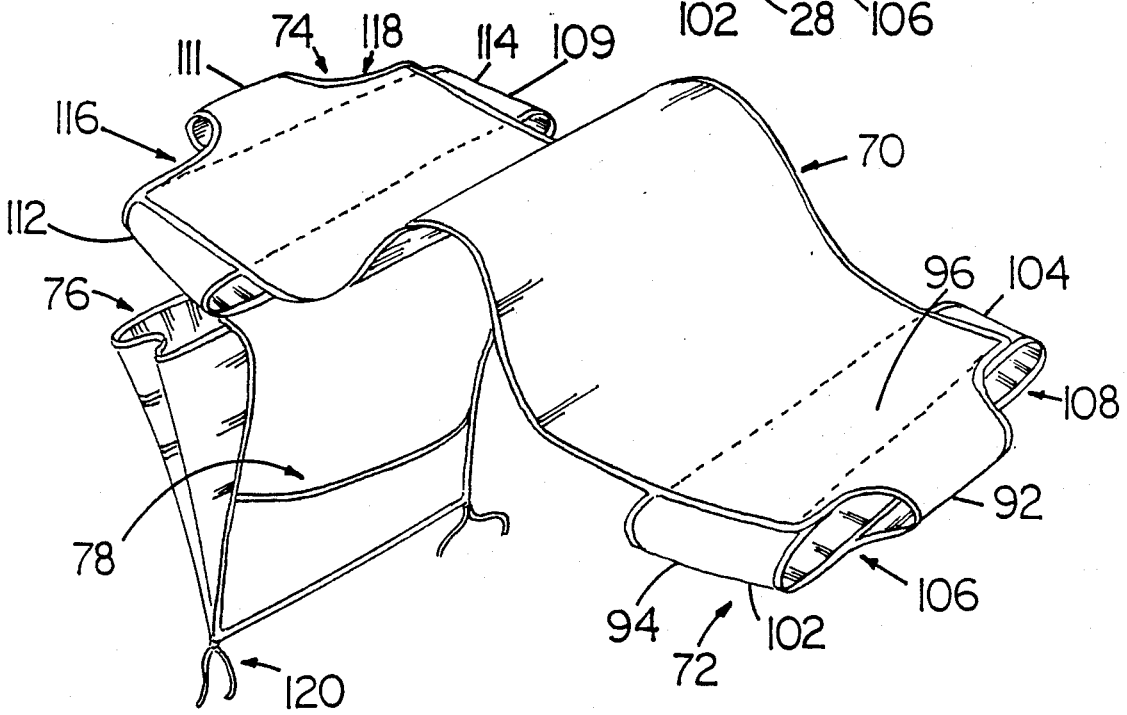
FIG. 5 is a perspective view of the covering of FIG. 1 removed from the frame.
Figure 8:
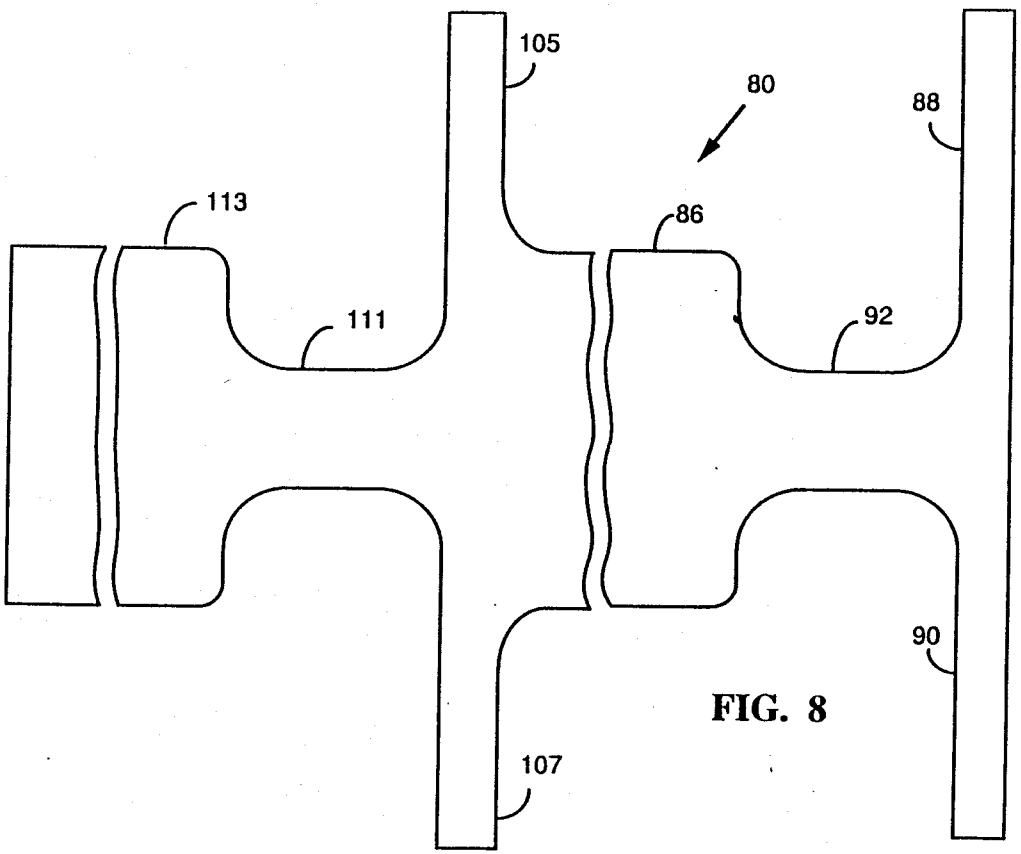
FIG. 8 is a plan view of a sheet of fabric from which the covering of FIG. 1, 5 and 5 may be formed.

The seat and back support portion 70 and the lower pocket 72 and may formed by cutting a piece of fabric 80 to have a generally T-shaped section 82 and a generally rectangular central section 86 as shown in FIG. 8. The lower pocket 72 may then be formed by folding the fabric so that arms 88 and 90 of the T-shaped section 82 overlap and then sewing the fabric together to form a closed loop 94. The fabric is then folded along the leg 92 of the T-shaped section 82 so that the loop 94 overlaps a portion 96 of the seat and back support portion 70 as shown in FIGS. 5 and 6. The loop 94 may then sewn to the seat and back support portion 70 to form the lower pocket 72 as also shown in FIGS. 5 and 6. The fabric sections 88 and 90 preferably overlap sufficiently to provide two layers of fabric in the lower pocket 72.

Referring to FIGS. 1 and 5, the lower pocket 72 may be slipped over the section 22 of the lower frame section 14. When the covering 16 is mounted on the lower frame section 14, a portion 100 of the leg 92 of the T-shaped section 82 contacts the section 22 of the lower frame section 14. The end edges 102 and 104 of the lower pocket 72 engage the curved sections 24 and 26, respectively, of the lower frame section 14. The lower frame section 14 and the lower pocket 72 thus cooperate to hold the seat portion away from the surface that supports the folding chair 10. The curved sections 28 and 30 will project from openings 106 and 108, respectively, in the lower pocket 72 when it is formed from a T-shaped section of fabric as described above.

The upper pocket 74 may be formed to be substantially identical with the lower pocket 72. Referring to FIG. 8, a pair of generally rectangular sections 105 and 107 may extend from the central section 86. The sections 105 and 107 are folded over one another and sewn together to form a loop 109 that is similar to the loop 94. A section 111 of the fabric 80 that is about the same width as the leg 92 of the T-shaped section 82 extends from the loop 109. Another generally rectangular section 113 having about the same width as the seat and back support portion 70 extends from the section 111 in line with the central section 86. The fabric 80 is then folded along this narrowed section 111, and the loop 109 is sewn to the rectangular section 113. The pockets 72 and 74 should be on the same side of the sheet of fabric 80 when they are sewn to it.

The section 111 of the upper pocket 74 contacts the section 40 of the upper frame section 12 when the covering 16 is mounted to the upper frame section 12. Ends 112 and 114 of the upper pocket 74 contact the curved sections 42 and 44, respectively, of the upper frame section 12. The curved sections 46 and 48 will project from openings 116 and 118, respectively, in the upper pocket 74 when it is formed from a T-shaped section of fabric as described above. The fabric portions 105 and 107 preferably overlap sufficiently to provide two layers of fabric in the upper pocket 74.

Referring again to FIG. 1, mounting the covering 16 on the upper frame section 12 and lower frame section 14 may be accomplished by rotating the upper frame section 12 clockwise toward the lower frame section 14 and slipping one of the pockets 72 and 74 over the outer end of its corresponding frame section. The other pocket is then slipped over the outer end of its frame section, and the frame sections 12 and 14 are rotated away from one another to place the legs 18 and 20 of the lower frame section 14 at the desired angle with the legs 36 and 38 of the upper frame section 12.

The user may then sit in the folding chair 10 and adjust the angle of the seat and back merely by shifting his weight forward or backward as necessary. No other adjustment is necessary to move upper frame to a desired angle and retain the angle until the user again decides to shift his weight. There are no stops or notches in the frame to hold it in the desired position. The folding chair 10 operates on a counter balance principle to position the user's body as though it were in a sling.

The seat back angle is continuously variable between its limits. The length of the fabric between the central sections 22 and 40 determines how far back the upper frame section 12 may be rotated relative to the lower frame section 14. The chair 10 is preferably formed so that the range of adjustment of the upper frame section varies continuously between straight up and a full reclining position for the occupant. The length of the covering 16 is preferably such that if the occupant of the folding chair 10 attempts to move the upper frame section forward beyond the vertical, the covering 16 will no longer support his weight. The person's weight will then rest on the surface that supports the chair rather than on the chair itself. Therefore, there is no tendency of the upper frame portion 12 to rotate forward beyond the vertical. This prevents damage that could occur if ends of the tubes were forced together near the hinge 49.

The vertical and horizontal forces on the upper portion of the upper frame section 12 cause essentially equal and opposite torques about the longitudinal axis of the bolt 55. Therefore, the upper frame section 12 and the lower frame section 14 do not have a tendency to rotate about the bolt 55 when a person sits in the folding chair 10. If the torques are not exactly balanced, then friction in the hinge prevents unwanted rotation of the frame sections 12 and 14.

Referring to FIGS. 1, 6 and 7, the first pouch 76 may be formed from the generally rectangular section 113 of the fabric if the section 113 is long enough to extend away from the upper pocket 74. The section 113 may be folded back on itself and a pair of side members 115 and 117 sewn to its edges to form the first pouch 76. The second pouch 78 may be formed by sewing a rectangular section of fabric to the section 113 on the side opposite the first pouch 76.

The covering 16 may also include two sets of strings 120 or the like attached to the lowermost edge of the section 113. Referring to FIGS. 1 and 6, the strings 120 may be used to secure the bottom of the first pouch 76 to the legs 36 and 38 of the upper frame section 12.

When the folding chair 10 is not in use or when it is being transported, the lower pocket 72 may be dismounted from the lower frame section 14. The lower frame section 14 may then be rotated around to the back of the upper frame section 12 so that the frame sections 12 and 14 are in close proximity with the pouch 76 between them. The lower pocket 72 and the seat and back support portion 70 may then be rolled up and placed in the pouch 76. The folding chair 10 may then be conveniently carried in a manner similar to a suitcase using the longer frame section as a handle.

Straps (not shown) may be attached to the folding chair 10 so that it may be carried similar to a backpack. The straps may be passed through holes (not shown) in the legs 36 and 38 near their hinged connections with the legs 18 and 20, respectively.

The structure of the lower pocket 72, the upper pocket 74, the upper frame section 12 and the lower frame section 14 cooperate to support the weight of a person sitting in the folding chair 10 without causing excessively high stresses anywhere in the covering 16 or any pressure points to the user's body. When a person sits in the folding chair 10, the position of his body adjusts the covering 16 so that the weight is distributed evenly on the portions of the lower pocket 72 and upper pocket 74 that contact the lower frame section 14 and the upper frame section 12, respectively.

What is claimed is:

1. A folding chair, comprising:

a lower frame section formed generally as a U-shaped member;

an upper frame section formed generally as a U-shaped member;

a pair of hinges for connecting the lower frame section and the upper frame section together, each hinge including:

a bolt;

a support ring mounted on the bolt;

an end of one of the frame sections pivotally mounted on the bolt adjacent the support ring;

an end of the other frame section pivotally mounted on the bolt, the support ring being formed to have an outer surface that extends beyond the end edges of the frame sections such that when the chair rests upon a hard, flat surface such as a floor, the support ring contacts the floor while holding the ends of the frame sections above the floor;

means mounted on the bolt between the ends of the frame sections for permitting the frame sections to rotate about the bolt relative to one another while preventing frictional contact between the frame ends; and a covering mounted to the upper and lower frame sections such that a person occupying the chair may adjust the angle between the upper and lower frame sections by shifting his weight in the chair.

2. A folding chair, comprising:

a lower frame section formed generally as a U-shaped member having a first pair of legs and a first central portion between the first pair of legs, the first pair of legs having substantially straight, parallel portions that define a first plane, the first central section having two ends, each end being connected to the substantially straight, parallel portions by a pair of curved frame portions curved such that the first central frame portion has a longitudinal axis that is displaced downward from the first plane when the folding chair rests upon a generally horizontal surface;

an upper frame section formed generally as a U-shaped member having a second pair of legs and a second central portion between the second pair of legs, the second pair of legs having substantially straight, parallel portions that define a second plane, the second central section having two ends, each end being connected to the substantially straight, parallel portions by a pair of curved frame portions curved such that the second central frame portion has a longitudinal axis that is displaced horizontally from the second plane when the second pair of legs are in a substantially vertical orientation;

means for pivotally connecting corresponding ends of the upper frame section and the lower frame section together; and a flexible seat and back portion mounted to the central portions of the upper and lower frame sections such that the flexible covering supports the weight of a person sitting in the chair when the central section of the lower frame section and the pivotally connected ends of the upper frame section and the lower frame section rest upon a substantially horizontal surface, the displacement of the first central frame from the plane of the first pair of legs, the displacement of the second central frame from the plane of the second pair of legs and the lengths of the legs and frictional forces in the pivotal connections between the legs cooperating to retain an angle between the first and second planes at an amount determined by the position of the user on the seat and back portion.

3. The folding chair of claim 2 wherein the connection between the ends of the upper and lower frame sections includes:

a flattened portion at the end of each leg, each flattened portion having a passage therethrough;

a first shaft passed through a first pair of adjacent legs of the upper and lower frame sections;

a second shaft passed through a second pair of adjacent legs of the upper and lower frame sections;

means for retaining the first and second shafts connected with the ends of the upper and lower frame sections; and first and second support rings mounted to the first and second shafts, respectively, the support rings having diameters such that the ends of the legs adjacent the pivotal connections do not extend beyond the outer edges of the support rings.

4. The folding chair of claim 2 wherein an first pouch is connected to the rear of the back portion.

5. The folding chair of claim 2 wherein an second pouch is connected to the first pouch such that the second pouch is between the second pouch and the rear of the back portion.

6. The folding chair of claim 2 wherein the seat and back section includes:

a lower pocket formed to fit upon the central portion of the lower frame section; and an upper pocket formed to fit upon the central portion of the upper frame section.

7. The folding chair of claim 6 wherein each of the lower and upper pockets includes a pair of cutout portions arranged so that the ends of the first and second central portions extend out of their respective pockets.

8. A method for forming a folding chair, comprising the steps of:

forming a lower frame section generally as a U-shaped member;

forming an upper frame section generally as a U-shaped member;

connecting the lower frame section and the upper frame section together with a pair of hinges, by the steps of:

mounting a support ring on a bolt;

pivotally mounting an end of one of the frame sections on the bolt adjacent the support ring;

pivotally mounting an end of the other frame section on the bolt adjacent the support ring;

forming the support ring being to have an outer surface that extends beyond the end edges of the frame sections such that when the chair rests upon a hard, flat surface such as a floor, the support ring contacts the floor while holding the ends of the frame sections above the floor;

mounting means on the bolt between the ends of the frame sections for permitting the frame sections to rotate about the bolt relative to one another while preventing frictional contact between the frame ends; and mounting a covering to the upper and lower frame sections such that a person occupying the chair may adjust the angle between the upper and lower frame sections by shifting his weight in the chair.

9. A method for forming a folding chair, comprising the steps of:

forming a lower frame section generally as a U-shaped member having a first pair of legs and a first central portion between the first pair of legs;

forming the first pair of legs to have substantially straight, parallel portions that define a first plane;

forming the first central section to have two ends;

connecting each end to the substantially straight, parallel portions by a pair of curved frame portions curved in mutually perpendicular planes such that the first central frame portion has a longitudinal axis that is displaced downward from the first plane when the folding chair rests upon a generally horizontal surface;

forming an upper frame section generally as a U-shaped member having a second pair of legs and a second central portion between the second pair of legs;

forming the second pair of legs to have substantially straight, parallel portions that define a second plane;

forming the second central section to have two ends;

connecting each end to the substantially straight, parallel portions by a pair of curved frame portions curved in mutually perpendicular planes such that the second central frame portion has a longitudinal axis that is displaced horizontally from the second plane when the second pair of legs are in a substantially vertical orientation;

connecting the upper frame section and the lower frame section having ends that are pivotally together; and mounting a flexible seat and back portion to the central portions of the upper and lower frame sections such that the flexible covering supports the weight of a person sitting in the chair when the central section of the lower frame section and the pivotally connected ends of the upper frame section and the lower frame section rest upon a substantially horizontal surface, the displacement of the first central frame from the plane of the first pair of legs, the displacement of the second central frame from the plane of the second pair of legs and the lengths of the legs and frictional forces in the pivotal connections between the legs cooperating to retain angle between the first and second planes at an amount determined by the position of the user on the seat and back portion.

10. The method of claim 9 wherein the step of connecting the ends of the upper and lower frame sections together includes the steps of:

forming a flattened portion at the end of each leg;

forming a passage through each flattened portion;

passing a first shaft through a first pair of adjacent legs of the upper and lower frame sections;

passing a second shaft through a second pair of adjacent legs of the upper and lower frame sections;

retaining the first and second shafts connected with the ends of the upper and lower frame sections; and mounting first and second support rings to the first and second shafts, respectively, the support rings having diameters such that the ends of the legs adjacent the pivotal connections do not extend beyond the outer edges of the support rings.

11. The method of claim 9 including the step of forming an first pouch connected to the rear of the back portion.

12. The method of claim 9 including the step of forming a second pouch connected to the first pouch such that the second pouch is between the second pouch and the rear of the back portion.

13. The method of claim 9 wherein the seat and back section includes:

forming a lower pocket formed to fit upon the central portion of the lower frame section; and forming an upper pocket formed to fit upon the central portion of the upper frame section.

14. The method of claim 13 including the step of forming each of the lower and upper pockets includes a pair of cutout portions arranged so that the ends of the first and second central portions extend out of their respective pockets.

* * * * *